United States Patent [19]

Wormly

[11] 4,322,042

[45] Mar. 30, 1982

[54] TOILET PAPER CONTAINER AND DISPENSER

[76] Inventor: Thaddaues H. Wormly, 1218-20 Liberty St., Camden, N.J. 08104

[21] Appl. No.: 204,217

[22] Filed: Nov. 5, 1980

[51] Int. Cl.[3] ..... B65H 19/00

[52] U.S. Cl. ..... 242/55.54; 242/55.53

[58] Field of Search ..... 242/55.3, 55.53, 55.54, 242/71.1; 225/33, 46, 47, 54, 67, 88

[56] References Cited

U.S. PATENT DOCUMENTS

| | | | |
|---|---|---|---|
| 3,790,097 | 2/1974 | Wormly | 242/55.53 |
| 3,806,057 | 4/1974 | Whatley | 242/55.54 |
| 4,034,929 | 7/1977 | Ebner, Jr. | 242/71.1 |

*Primary Examiner*—Leonard D. Christian
*Attorney, Agent, or Firm*—Robert K. Youtie

[57] ABSTRACT

A toilet paper storage dispenser including an upright enclosure having a central paper roll guide for placing toilet paper rolls into the upper enclosure end circumposed about the guide and withdrawing the rolls from the lower enclosure end journaled on the guide, a lateral extension on the lower guide end and an upstanding connector from the extension rigidly connected to the enclosure, a swingable lid or top wall over the upper enclosure end, and releasable interfitting formations on the inner side of the top wall and upper end of the guide for restraining the latter against movement out of its central alignment within the enclosure.

10 Claims, 4 Drawing Figures

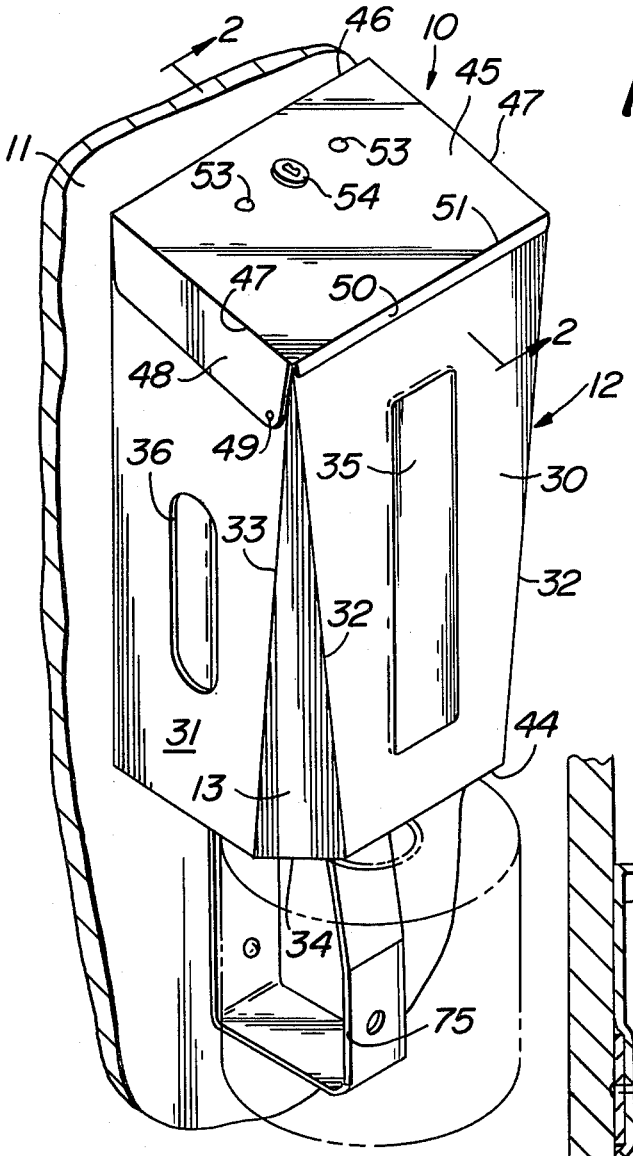
FIG. 1
FIG. 3
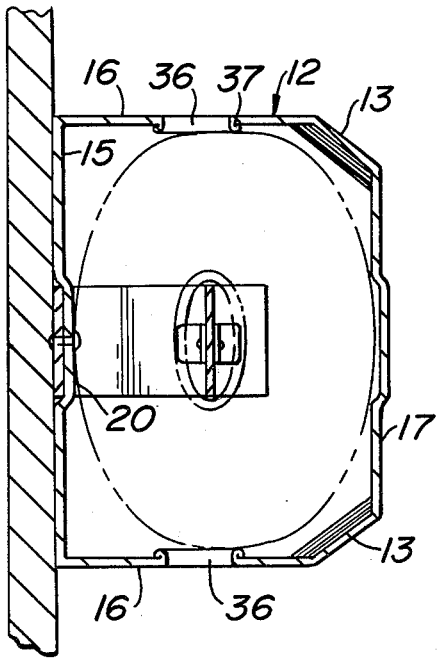

TOILET PAPER CONTAINER AND DISPENSER

BACKGROUND OF THE INVENTION

In the equipping of commercial and public restrooms with toilet paper storage dispensers, there are often horizontal space problems requiring a vertical or upright arrangement of device to occupy a minimum of horizontal space. This has heretofore involved certain problems not entirely satisfactorily overcome, including convenient filling of the storage dispenser, ease of mounting to a supporting wall, affording security to the toilet paper contents, resistance to damage by hard and abusive use, and limitation to the use of smaller toilet paper rolls of 1000 sheets.

The invention of the instant application is an improvement upon the invention of my earlier U.S. Pat. No. 3,790,097.

SUMMARY OF THE INVENTION

Accordingly, it is an important object of the present invention to provide a toilet paper roll storage dispenser which is capable of upright disposition in use to occupy a minimum of horizontal space, is readily adapted to be speedily filled by service personnel, is capable of use with larger toilet paper rolls up to 1800 sheets, provides effective security against theft of the paper as well as the device, is well adapted to resist abusive use as well as vandalism, and otherwise fully accomplishes its intended objects.

Other objects of the present invention include the removal of sharp corners and edges for greater safety, the provision of a locking closure to prevent pilferage while maintaining full access for introducing paper into the storage chamber, and the provision of an extremely simple combination toilet paper roll guide and dispensing support which effectively cooperates with the storage compartment closure for greatly enhanced strength and resistance to damage.

Other objects of the present invention will become apparent upon reading the following specification and referring to the accompanying drawings, which form a material part of this disclosure.

BRIEF DESCRIPTION OF THE DRAWINGS

FIG. 1 is a top perspective view showing a toilet paper roll storage dispenser of the present invention in operative association with a supporting wall, toilet paper rolls being shown in phantom.

FIG. 3 is a horizontal sectional view taken generally along the line 3—3 of FIG. 2.

DESCRIPTION OF THE PREFERRED EMBODIMENT

Figure 2:
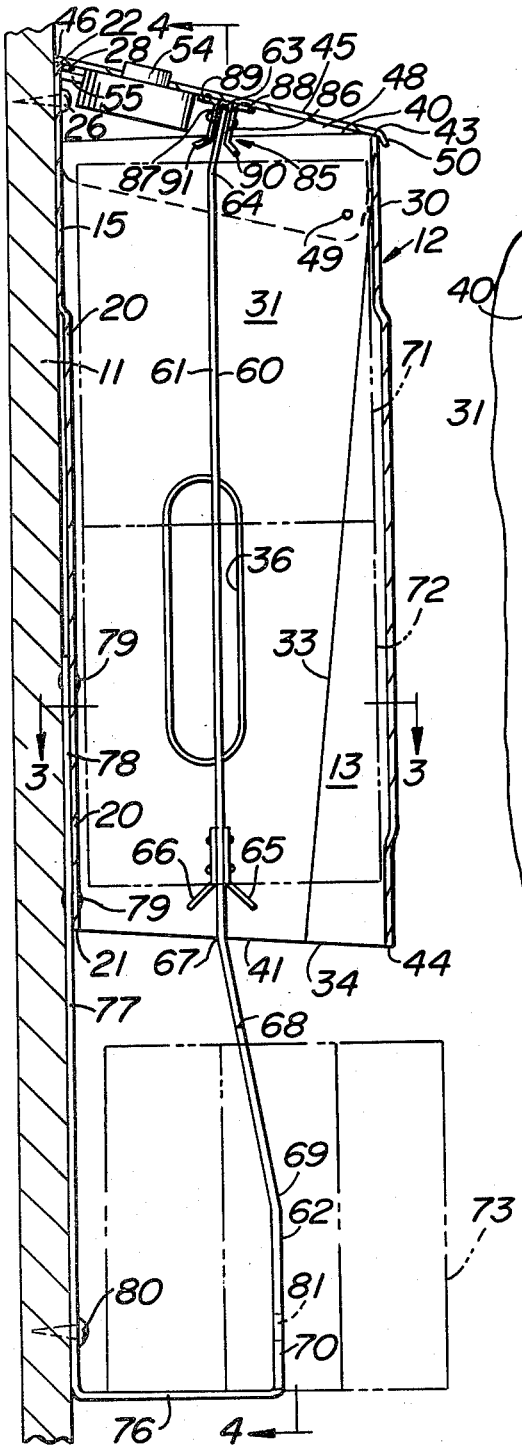
FIG. 2 is a vertical sectional view taken generally along the line 2—2 of FIG. 1.
Figure 4:
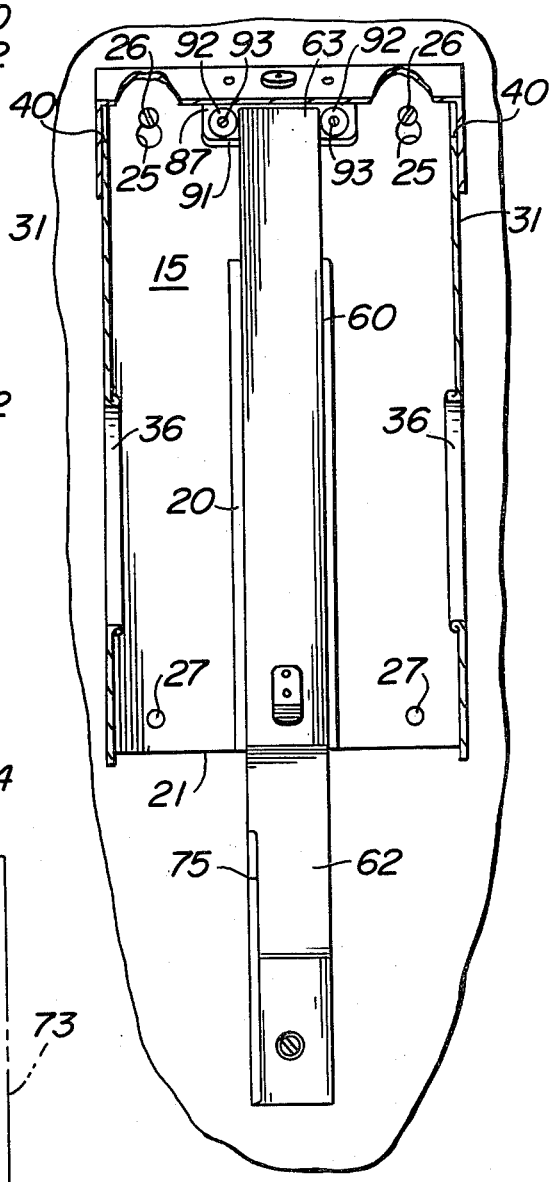
FIG. 4 is a vertical sectional view taken generally along the line 4—4 of FIG. 2.

Referring now more particularly to the drawings, and specifically to FIG. 1 thereof, a toilet paper roll storage dispenser is there generally designated 10 and arranged in vertical or upright relation for mounting on a vertical supporting surface or wall 11, as in a commercial or public restroom. The storage dispenser 10 includes a vertically elongate or upright enclosure 12, which may be of generally rectangular horizontal cross-sectional configuration, but has its front corners of increasing chamfer 13 in the downward direction, as seen in FIGS. 1 and 3.

More specifically, the enclosure 12 may include a generally vertical back wall 15 adapted for securement to the supporting surface 11, a pair of generally vertical side walls 16 extending forwardly or outwardly from opposite side edges of the back wall, and a generally vertical front wall 17 extending generally between the forward regions of the side walls and joined thereto by the chamfered or bevelled surfaces 13.

The back wall 15 is generally flat, except for a vertically extending, laterally medial rib 20 defined by a forwardly depressed portion of generally rectangular configuration extending upwardly from the lower edge 21 of the back wall and terminating short of the upper back wall end 22. The back wall 15 is provided in its upper end region with a pair of laterally spaced fastener receiving openings 25, preferably of inverted key-hole shaped configuration for receiving fasteners 26. The back wall 15 is provided adjacent to its lower edge at laterally spaced locations with suitable openings for receiving fasteners 27. The upper end of the back wall 15 is provided with a retaining ledge, lip or catch 28 which declines forwardly from the back wall. The fasteners 26 and 27 may be screws or the like, with end enlargements or heads for retaining engagement with back wall material adjacent to the reduced regions of upper end openings 25, and the bounding regions of openings receiving fasteners 27.

A generally vertically disposed front wall 30, in forwardly spaced parallelism with back wall 15, may be formed integrally with a pair of generally vertically disposed, parallel spaced side walls 31 extending rearwardly from opposite sides of the front wall to opposite side edges of the rear wall 15. In practice, the side walls 31 may be permanently secured, as by welding or the like, to the back wall 15. The forward region of each side wall 31 is secured to the adjacent region of front wall 30, as by integral formation of an oblique or bevelled wall portion 13 defining the downwardly increasing chamfer. That is, the front and side wall connecting portions 13 are of generally triangular formation, being generally of isosceles formation, being defined between downwardly diverging front and side wall intersections 32 and 33, terminating in a lower or base edge 34.

The front wall 30 may be formed laterally medially thereof with a vertically elongate forwardly depressed portion or rib 35, affording rigidity and strength to the material of the front wall.

Each of the side walls 31 may be formed, laterally medially thereof with a vertically elongate through opening, slot or hole 36. The vertically elongate slots 36 may be formed with rolled or doubled back edges, as at 37 in FIG. 3, for both smoothness and structural reinforcing. The openings or slots 36 are located at a level to indicate visually the number of toilet paper rolls stored or contained within the enclosure 12, and also to afford manual access to the contained rolls for feeding the same downwardly to a dispensing position.

The side walls 31 are substantially identical, each having a generally horizontal upper edge 40 which may be spaced below the upper edge 22 of the rear wall, and the upper rear wall fastener receivers 25. The lower edge 41 of each side wall 31 extends forwardly and obliquely downwardly from the lower edge 21 of the rear wall 15 to the lower end of meeting edge or bend 33. The lower edge 34 of each triangular or chamfered wall portion 13 continues forwardly and obliquely downwardly to intersection with the lower end of the adjacent meeting edge or bend 32.

The front wall 30 has its upper edge generally horizontal, as at 43, which is generally flush or level with and extends between the forward ends of the upper side wall edges 40. The lower end edge 44 of the front wall 30 is also generally horizontal and extends laterally between the forward ends of the lower edges 34 of chamfered wall portions 13. Thus, the lower front wall edge 44 is spaced below the lower rear wall edge 21. This effectively obscures and deters unauthorized access to the rear wall fasteners 27. If desired, one or more of the lower wall edges 41, 34, 44 may be provided with rolled or inturned edge portions for smooth finishing and reinforcement.

Superposed over the open upper end of enclosure 12 is a top wall, closure or lid 45. The top wall may be generally rectangular in outline configuration, as best seen in FIG. 1, and in the illustrated, closed condition extending forwardly or outwardly and obliquely downwardly between the upper edge 22 of rear wall 15 at the upper edge 43 of front wall 30. More specifically, the top wall 45 has a rear, upper edge 46 resting, in the closed top wall condition, on the ledge or catch 28. The laterally opposite side edges 47 of the top wall 45 are located respectively over the upper edges 40 of side walls 31, and are each provided with a depending, generally rectangular extension or flap 48 overlying the upper portion of the adjacent side wall 31. The depending side portions or flaps 48 are each pivotly secured or pinned at a lower region, say by a pivot or pin 49, to the adjacent underlying side wall 31. Thus, the top wall 45 is mounted for swinging movement about the aligned, horizontal axes of pins 49 between the illustrated closed position, and an upwardly and forwardly swung open position. In the open position, the top wall 45 will be removed laterally from over the enclosure 12 to afford convenient access for downward entry of toilet paper rolls.

A front lip or flange 50 may extend along the forward edge 51 of the top wall 45, depending so as to obscure the upper edge 43 of front wall 30, and enhance security.

Further enhancing security may be a key lock 52 mounted on the inner side of top wall 45, as by fasteners 53, with a key receiver 54 exposed through the outer side of the top wall. A locking member or bolt 55, see FIG. 2, is extensible leftward beneath catch 28, and retractable rightward from beneath the catch, for locking and unlocking the top wall or lid 45.

As the depending side portions or flaps 48 overlie and close the space between the top wall 45 and upper side wall edges 40, it will be understood that the fasteners 26 are effectively secure against tampering.

Disposed generally centrally in spaced relation within the enclosure 12 is an elongate member or toilet roll guide 60. The roll guide 60 may be formed of bar stock including a generally upright upper or storage portion 61 within the enclosure 12, and extending integrally downwardly therefrom a lower, dispensing portion 62. The upper end region 63 of roll guide 60 is bent obliquely forwardly, as at 64, to a disposition generally normal to the plane of top wall 45 when the latter is closed. Adjacent to the lower open end of the enclosure 12, and within the enclosure, there are provided on opposite sides of the elongate bar or roll guide 60 a pair of, respectively forwardly and rearwardly, obliquely downwardly extending spring fingers or roll holders 65 and 66.

Generally level with the lower open end of enclosure 12, the roll guide 60 is bent, as at 67, extending therefrom obliquely forwardly and downwardly, as at 68 to a lower bend 69, from which the dispensing roll guide portion extends generally vertically downwardly.

Thus, it will be seen, as in FIG. 2, that the upper storage portion 61 of roll guide 60 is located centrally within the enclosure 12, at a position closer to the supporting wall 11 than the lower end region 70 of the dispensing roll guide portion 62. The storage space projecting into the lavatory is thus minimized, as the stored upper and lower toilet paper rolls 71 and 72 are oblately compressed, see FIG. 3, when in the enclosure 12. This oblate compression does not adversely effect the quality or condition of the toilet paper rolls, nor prevent downward passage through the enclosure under deliberate downward manual force. However, the inadvertent downward movement of stored rolls is effectively resisted or prevented by the spring fingers or stop members 65 and 66 engaging beneath the lower stored rolls 72.

When the lowermost, dispensing roll 73 is used, its core may be torn from the lower dispensing roll guide portion 62, and the next lower, stored roll 72 may be moved downwardly along the roll guide 60 into the dispensing position. That is, the lower stored roll 72 may be forced past the stop member 65 and 66, as by deflection of the latter and expansion of the roll, onto the lower, dispensing portion 62 of roll guide 60. In this condition, the dispensing roll 73 may expand from its compressed condition to return to a generally circular configuration.

The lower, dispensing portion 62 of roll guide 60 may advantageously be cut away, as at 75, to reduce the width of the roll guide and enable a dispensing roll to more freely rotate in dispensing paper sheets. This cut out 75 and reduced width may be desirable in those locations not plagued by pilferage and abuse, but in such locations the cut out 75 may be omitted to increase difficulty with which paper may be withdrawn from the dispensing roll.

Extending generally horizontally from the lower end of the dispensing roll guide portion 62, preferably integral therewith, is a lateral extension 76, which extends to the supporting surface or wall 11. Extending generally vertically upwardly from the lateral extension 76, along the supporting wall of surface 11, is a connector 77, which may have its upper end region 78 comformably received in the depressed portion 20 of rear wall 15 and fixedly secured thereto, as by rivets 79 or other suitable fastening means.

Thus, the connector 77, lateral extension 76 and roll guide 60 may all be integrally formed of a single piece of bar stock or strip material bent to a generally U-shaped configuration with the lateral extension 76 defining the bight and the connector 77 and roll guide 60 defining the legs. Also, the connector 77 by fastener 79 makes a single unit of the device to assure simple and proper mounting, and resultant proper operation.

The lower region of the connector 77 may advantageously be secured fast to the supporting surface or wall 11, as by a fastener 80; and, access to the fastener 80 may be afforded by an opening 81 in alignment with the fastener, as for manipulation of a screw driver, or the like.

Provided on the underside of the top wall 45 is a receiver 85 for removable, comformably receiving relation with the upper end region 63 of the roll guide 60. That is, upon opening and closing of the top wall 45, the receiver 85 goes into and out of receiving relation with the upper roll guide portion 63. In the open top wall condition the upper end of the roll guide 60 is free for circumposed engagement thereon of the toilet paper rolls. However, upon closure of the top wall 45, an interfitting relationship is assumed between the projecting roll guide end 63 and receiver 85. In this interfitting relation, the roll guide is effectively constrained against lateral displacement, being thereby rigidified to assure proper operation as a guide for the toilet paper rolls, and highly resistant to damage in use, abusive conditions and vandalism.

More specifically, the receiver 85 may include a pair of generally parallel, spaced apart plates 86 and 87, which are disposed generally normal to and on the under or inner side of top wall 45, being fixedly secured thereto, as by welded or otherwise fastened flanges 88 and 89. Remote from the top wall 45, the parallel plates 86 and 87 are each provided with a laterally extending lip or flange, as at 90 and 91, which flanges diverge from each other in the direction away from the top wall 45, as best seen in FIG. 2. Thus, the flanges 90 and 91 serve as guides for guiding the three upper end 63 of roll guide 60 into the space between the receiver plates 86 and 87.

At laterally spaced locations between the receiver plates 86 and 87 there are mounted a pair of spacers or discs 92, as by central pins or fasteners 93. The discs or spacers 92 further serve to receive therebetween and guide the upper end region 63 of roll guide 60 into the receiver 85, for effective restraint of the roll guide against lateral displacement. That is, the plates 86 and 87 effectively restrain against forward and rearward displacement of the roll guide 60, while the spacers 92 restrain against lateral displacement. If desired, the spacer discs 92 may rotate, to constitute rollers further facilitating interengagement between the receiver 85 and roll guide 60.

From the foregoing, it is seen that the present invention provides a toilet paper storage dispenser for storing generally vertically disposed toilet paper rolls in a vertically stacked relation to minimize space requirements, wherein operation is simple and entirely reliable, security against pilferage and vandalism is extremely high, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A toilet paper storage dispenser comprising an open ended upright enclosure having elongate front, back and side walls; the upper and lower ends of said enclosure being open for respectively receiving and delivering toilet paper rolls; said back wall being adapted for attachment to an upright supporting surface, an elongate toilet paper roll guide disposed longitudinally of and centrally within said enclosure having its lower region extending downwardly through and beyond the lower end of said enclosure for extension through toilet paper rolls passing downwardly through storage positions in said enclosure and a dispensing position beneath said enclosure; a lateral extension on the lower end of said guide for extending toward a supporting wall; a connector extending between said lateral extension and enclosure back wall for securement of said guide to said enclosure; a top wall extending across the upper end of and hingedly connected to said enclosure for swinging movement between open and closed positions respectively affording and denying access to the upper enclosure end; and releasable interfitting means on said top wall and the upper region of said roll guide movable into and out of interfitting engagement upon closing and opening of said top wall, to effect restraint against movement of said roll guide.

2. A toilet paper storage dispenser according to claim 1, said top wall declining forwardly in its closed position; and said interfitting means comprising a forwardly inclined upper end portion on said roll guide, and a rearwardly declining receiver on the under side of said top wall removably receiving said upper end roll guide portion when said top wall is closed.

3. A toilet paper storage dispenser according to claim 2, in combination with pivot means mounting said top wall for swinging movement about an axis adjacent to said front wall for upward and forward opening movement and rearward and downward closing movement, a catch extending forwardly from the back wall, and a bolt carried by said top wall removably shiftable into and out of locking engagement beneath said catch.

4. A toilet paper storage dispenser according to claim 3, said pivot means comprising a pair of side pieces depending from opposite sides of said top wall along respective enclosure side walls, and aligned pins extending through said side pieces and enclosure side walls adjacent to said front wall.

5. A toilet paper storage dispenser according to claim 1, said roll guide, lateral extension and connector being integral, and said connector being rigidly secured in facing engagement with the exterior of said back wall.

6. A toilet paper storage dispenser according to claim 5, said back wall being formed with a longitudinal forwardly depressed rib extending upwardly from the lower back wall edge, and said connector having its upper region comformably received in said rib.

7. A toilet paper storage dispenser according to claim 6, said integral roll guide, lateral extension and connector being constituted of a single piece of bar stock bent about its major transverse dimension into a generally U-shaped configuration having legs defining said connector and roll guide and a bight region defining said lateral extension; and said releasable interfitting means comprising the upper end region of said roll guide leg, and a receiver on the under side of said top wall removably receiving said upper end leg region when said top wall is closed.

8. A toilet paper storage dispenser according to claim 7, said receiver flaring outwardly to facilitate entry therein and central alignment of said roll guide leg.

9. A toilet paper storage dispenser according to claim 1, said enclosure being of generally rectangular horizontal cross-sectional configuration with the front and side wall intersections of increasing chamfer in the downward direction, to minimize sharp corners.

10. A toilet paper storage dispenser according to claim 1, said back wall having fastener openings adjacent to its upper and lower ends, the lower end of said front wall depending beyond the lower end of said back wall to conceal the lower fastener openings.

* * * * *